US012760894B2

(12) United States Patent
Laux et al.

(10) Patent No.: US 12,760,894 B2
(45) Date of Patent: Oct. 13, 2026

(54) METHOD FOR CONTROLLING A BURNER AND BURNER ARRANGEMENT HAVING A BURNER

(71) Applicant: Truma Gerätetechnik GmbH & Co. KG, Putzbrunn (DE)

(72) Inventors: Wilhelm Laux, Putzbrunn (DE); Bastian Rothmer, Putzbrunn (DE); Daniel Schättler, Putzbrunn (DE)

(73) Assignee: Truma Gerätetechnik GmbH & Co. KG, Putzbrunn (DE)

( * ) Notice: Subject to any disclaimer, the term of this patent is extended or adjusted under 35 U.S.C. 154(b) by 349 days.

(21) Appl. No.: 18/717,346

(22) PCT Filed: Nov. 30, 2022

(86) PCT No.: PCT/EP2022/025541

§ 371 (c)(1),
(2) Date: Jun. 6, 2024

(87) PCT Pub. No.: WO2023/110144

PCT Pub. Date: Jun. 22, 2023

(65) Prior Publication Data

US 2025/0035310 A1 Jan. 30, 2025

(30) Foreign Application Priority Data

Dec. 14, 2021 (DE) ..... 102021006182.9

(51) Int. Cl.
*F23N 5/12* (2006.01)
*F23D 14/02* (2006.01)

(52) U.S. Cl.
CPC ..... *F23N 5/123* (2013.01); *F23D 14/02* (2013.01); *F23N 2223/36* (2020.01); *F23N 2223/42* (2020.01)

(58) Field of Classification Search
None
See application file for complete search history.

(56) References Cited

U.S. PATENT DOCUMENTS 5,796,342 A * 8/1998 Panov ..... F23N 5/082 431/13
5,899,683 A 5/1999 Nolte et al.
(Continued)

FOREIGN PATENT DOCUMENTS

DE 19502901 C1 3/1996
DE 19631821 A1 2/1998
(Continued)

OTHER PUBLICATIONS

WO_2020228979_A1—English translation (Year: 2020).*

*Primary Examiner* — Jorge A Pereiro
(74) *Attorney, Agent, or Firm* — Murphy, Bilak & Homiller, PLLC

(57) ABSTRACT

A method of regulating a burner which is supplied with an air-fuel mixture includes: determining a regulating variable based on an ionization signal, the air-fuel mixture being set depending on the regulating variable and a setpoint value; obtaining a spectrum from the ionization signal, from which a measure for a surface area is determined; and adjusting the setpoint value depending on the measure for the surface area. Also described is a burner arrangement including a burner.

10 Claims, 2 Drawing Sheets

(56) References Cited

U.S. PATENT DOCUMENTS

| | | | | |
|---|---|---|---|---|
| 6,341,519 | B1 * | 1/2002 | Khesin | G01N 27/407 73/23.31 |
| 6,356,199 | B1 | 3/2002 | Niziolek et al. | |
| 2011/0070550 | A1 * | 3/2011 | Arensmeier | F23N 5/123 431/12 |
| 2015/0348393 | A1 * | 12/2015 | Margolin | G08B 17/125 340/577 |
| 2020/0018481 | A1 * | 1/2020 | Arensmeier | F23N 5/242 |
| 2020/0309046 | A1 * | 10/2020 | Deivasigamani | F02D 35/021 |

FOREIGN PATENT DOCUMENTS

| | | | | |
|---|---|---|---|---|
| DE | 10220772 | A1 * | 11/2003 | F23D 14/60 |
| DE | 10220773 | A1 * | 11/2003 | F23N 5/123 |
| EP | 0770824 | A2 | 5/1997 | |
| EP | 2431663 | B1 | 12/2016 | |
| WO | WO-2020228979 | A1 * | 11/2020 | F23N 5/123 |

* cited by examiner a)

b)

METHOD FOR CONTROLLING A BURNER AND BURNER ARRANGEMENT HAVING A BURNER

TECHNICAL FIELD

The invention relates to a method of regulating a burner. The invention furthermore relates to a burner arrangement comprising a burner. The burner for example forms part of a device for heating room air and/or a liquid such as raw water.

BACKGROUND

Burners are used in heaters or hot water heaters in which the thermal energy obtained by the combustion of an air-fuel mixture is transferred to room air and/or a liquid such as water by a heat exchanger. The fuel is propane, butane, gasoline or diesel fuel, for example.

To monitor and regulate the presence of a flame or also the combustion quality itself, it is known from the prior art to use so-called ionization electrodes by means of which the ionization effect of a flame is used. The measured ionization signal in form of a voltage or current signal is evaluated and used for the regulation of the combustion behavior, in which for example the air ratio (also referred to as air/fuel ratio Lambda or mixture ratio) is set as a mass ratio of the combustion air to the fuel. This is carried out with the aim to ensure a combustion which is as clean and efficient as possible. For example, a gas valve and a combustion air blower are regulated depending on the ionization signal. A method of monitoring of gas burner based on the ionization signal is disclosed in DE 196 31 821 A1, for example.

Gas burners and in particular blower-operated gas burners, in particular as a part of mobile heating devices, are often exposed to changing ambient conditions which may lead to a changeable combustion behavior (see for example DE 102 20 773 A1). Such ambient parameters are the air pressure, the temperature of the combustion supply air, the gas pressure (i.e. the pressure at which the combustion gas is supplied), and also the calorific value of the gas. The composition of the combustion gas may also vary in particular in mobile applications. This is the case, for example, in typical gas mixtures such as LPG (liquefied petroleum gas; liquefied gas). Depending on the gas supply, the supply of pure propane, pure butane or also of an undefined propane/butane mixture is thus possible. In addition to increased emission figures, unfavorable combustion ratios can lead to disturbing noises due to thermoacoustic effects, which can also be avoided or at least significantly reduced by adjusting the air ratio.

DE 195 02 901 C1 for example discloses the application of an alternating voltage to the ionization electrode and the use of the air ratio-dependent variation of the ionization current for adjusting the supply of combustion air and gas. According to U.S. Pat. No. 6,356,199 B1, improved information about the combustion behavior is obtained from an extended analysis of the ionization signal by evaluating average values, the signal dispersion or the frequencies of the signal.

It can be taken from document EP 2 431 663 B1 that the ionization signals are subjected to a Fourier transformation and that the resulting spectra are evaluated. Reference spectra are generated for different burner types and compared with currently obtained spectra. If an instability of the combustion is determined during operation, the supply of combustion air and/or gas is changed until a spectrum is again measured, which indicates a stable combustion. For evaluation, the peaks of the spectra are each considered individually.

Further methods of regulating the combustion process are disclosed in documents DE 102 20 772 A1 and DE 195 02 901 C1.

When evaluating the spectra, it has been found to be disadvantageous that changes in the combustion system which comprises the burner lead to frequency shifts of the peaks in the spectra. Such changes are for example different temperature balances, changes in the combustion air or exhaust gas system, or changes in the burner surface. This reflects the fact that in the aforementioned method, each burner type and thus also each system in which the burner is applied, requires its own reference spectrum. However, it has to be considered that changes in the system can occur as a result of use or ageing. Furthermore, it is disadvantageous that disturbances occur in the spectra which originate from outside the system and have nothing to do with the combustion, such as the mains signal at 50 Hz. The evaluation is therefore generally very complex.

SUMMARY

Therefore, the object on which the invention is based is to propose a method of monitoring a combustion process which is as simple as possible and simultaneously reliable.

The invention achieves the object by a method of regulating a burner, wherein the burner is supplied with an air-fuel mixture, wherein an ionization signal is measured, wherein a regulating variable is determined based on the ionization signal, wherein the air-fuel mixture is set depending on the regulating variable and at least one setpoint value, wherein a spectrum is obtained from the ionization signal, wherein a value of an area is determined under the spectrum or under at least one frequency range of the spectrum, and wherein the setpoint value is adjusted depending on the value of the area.

According to the invention, the ionization signal is used for regulating the combustion. To this end, a regulating variable is obtained from the ionization signal. In addition, a setpoint value is used for regulation, which is for example initially specified or determined for the case of application. According to the invention, the setpoint value is adjusted based on the ionization signal. Therefore, information is taken from the ionization signal, by means of which the setpoint value is corrected. The corrected setpoint value can for example be used to avoid a disturbance, for example the generation of noise, by regulating in a different Lambda range.

According to the invention, a frequency spectrum is obtained from the time signal. This occurs, for example, via a Fourier transformation. A value for a surface area (this measure can also be referred to as area number) is then determined from the frequency spectrum. This is based on the findings that disturbances and in particular thermoacoustic effects occur as signals in the spectrum. Therefore, the area number allows information to be obtained as to whether disturbances are present or the combustion process generates noise. To leave this noise-loaded operating range, the setpoint value for regulation is adjusted appropriately, for example shifted, so that regulation occurs in a different air ratio range. In one embodiment, the measure for the surface area is obtained from a spectral range which is free from known disturbances such as the mains hum.

The evaluation of the area number has the advantage that frequency shifts due to changed ambient conditions or application conditions do not have to be considered or do not change the result of evaluation.

Preferably, the setpoint value is then adapted if the determined value of the area deviates beyond a tolerance value from a specified reference value and/or a reference value determined for the burner. In this embodiment, the value of the area determined under the spectrum is correlated with a reference value. The difference is for example calculated. If the difference increases beyond a predeterminable tolerance value, this is interpreted by the control device such that a disturbance, in particular a thermoacoustic resonance, is present or at least developing.

One embodiment of the method consists in that the ionization signal is subjected to a Fast Fourier transformation. The Fast Fourier transformation (FFT) allows a very effective method for transforming time-discrete signals.

In a further embodiment, it is provided that the regulating variable is adjusted based on the ionization signal. In this embodiment, the regulating variable is adjusted based on the ionization signal. In this embodiment, information is thus taken from the ionization signal, by means of which the regulating variable and the setpoint value are corrected. For example, a corrected regulating variable is thus obtained, the course of which allows a better reliable regulation or even a reliable regulation at all.

In one embodiment, the adjustment of the air-fuel mixture is carried out such that, on the one hand, a combustion which is as clean as possible and, on the other hand, as quiet as possible is performed. In the air ratio range in which the emissions are at a low level, regulation thus takes place such that resonances resulting from thermoacoustic effects disappear or are at least reduced.

The main advantage here is that thermoacoustic effects appear much earlier in the ionization signal than they lead to clearly audible noise.

According to one embodiment, at least one absolute value of the ionization voltage is determined from the ionization signal and used as a regulating variable. In the embodiment, the amplitude of the ionization voltage thus serves as a regulating variable. A setpoint value is preferably a setpoint amount of the voltage value.

An additional or alternative embodiment of the method is such that a plurality of individual absolute values of the ionization voltage is determined from the ionization signals, that a distribution of the individual absolute values is determined, and that the regulating variable is determined depending on the distribution. In this embodiment, individual absolute values of the ionization voltage are determined from the ionization signal. A distribution, i.e. a measure of the deviation of the individual absolute values from an average value, is determined based on the individual absolute values. The distribution then serves to correct the regulating variable. This variant of the method is based on the findings that the ionization voltage can change significantly if disturbances and in particular thermoacoustic effects occur. The variation of the voltage values was expressed in the distribution, so that a quantity is obtained for the further processing and in particular for the determination of a regulation variable. Accordingly, it can be concluded from an increasing distribution of the individual absolute values that a disturbing noise, for example, occurs. It is then possible to react accordingly earlier and to take countermeasures.

In one embodiment, the ionization signals originate from a predeterminable period of time in which the air ratio is substantially constant or varies only within a predeterminable range. Therefore, the settings are in particular not changed during the averaging period.

According to one embodiment, it is provided that an average value and the distribution are determined from the individual absolute values and that the regulating variable is determined as a difference between the average value and the distribution. In this embodiment, an average value of the amount of the ionization voltage is formed over a time period. The distribution of the voltage values is then subtracted from this average value. This difference serves as a regulating variable, for example. The larger the distribution and thus the variation of the ionization voltage, the smaller the regulating variable.

In one embodiment, it is provided that the evaluation of the individual absolute values is carried out in the manner of a moving average. In a supplementary embodiment, the ionization signals are evaluated in a predeterminable time interval (for example every five minutes) in a time period with a predetermined width (for example the measurements within five seconds).

According to one embodiment, the combustion behavior of the burner is regulated in a substantially permanent manner, and the distribution of the individual absolute values is continuously determined in terms of a moving average. In this embodiment, the method is for example designed such that the operation of the burner is regulated to a desired predeterminable operating point. This is with the lambda value of 1.5, for example. If the ambient conditions change in one direction, for example in the direction of a lean air-fuel mixture-for example by a change in the air pressure-this is reflected by the increasing distribution. The distribution changes above all before the average value shifts outside a predeterminable tolerance range. If the difference between the average value and the distribution is in particular used as a regulating variable, a regulation is triggered in the richer range. Here, in the normal case without disturbances, the ionization voltage decreases with an increasing air ratio. Tests have shown that in the range of disturbances, the ionization voltage increases or remains constant. Due to the aforementioned embodiment with the calculation of the difference between the average value and the distribution, a regulating variable is obtained to which regulation is possible, for example using a PID controller.

One embodiment of the method consists in that the air-fuel mixture is set depending on the regulating variable in the manner of a PID controller. A PID controller is thus for example provided or the behavior thereof is implemented accordingly to regulate the combustion behavior. A usual PID controller requires a continuous curve of the regulating variable. This is provided by the aforementioned variants of the method.

According to one embodiment of the method, the regulating variable is determined permanently or at predetermined points in time. Therefore, there is either a permanent monitoring such that regulation can also be carried out permanently, or the monitoring and regulation are carried out only at predetermined time intervals. The latter, for example, if changes requiring interventions occur infrequently or do not have to be compensated immediately.

According to a further teaching, the invention achieves the object by a burner arrangement comprising a burner, a heat exchanger, an ionization electrode, an air-fuel-mixture supply and a control device, wherein the control device receives and evaluates ionization signals measured by the ionization electrode, wherein the control device acts in a regulating manner on the air-fuel-mixture supply based on the evaluation of the ionization signals, and wherein the control device is configured such that the control device implements the method according to any of the embodiments described above or in the following. The explanations and embodiments also apply accordingly to the burner arrangement, so that repetition is omitted. The burner arrangement is for example part of a device for heating room air and/or a liquid such as water.

BRIEF DESCRIPTION OF THE DRAWINGS

More specifically, there are numerous possibilities for designing and further developing the method according to the invention and the burner arrangement according to the invention. For this purpose, reference is made, on the one hand, to the claims subordinate to the independent claims and, on the other hand, to the description below of example embodiments in conjunction with the drawing, in which:

DETAILED DESCRIPTION

Figure 1:
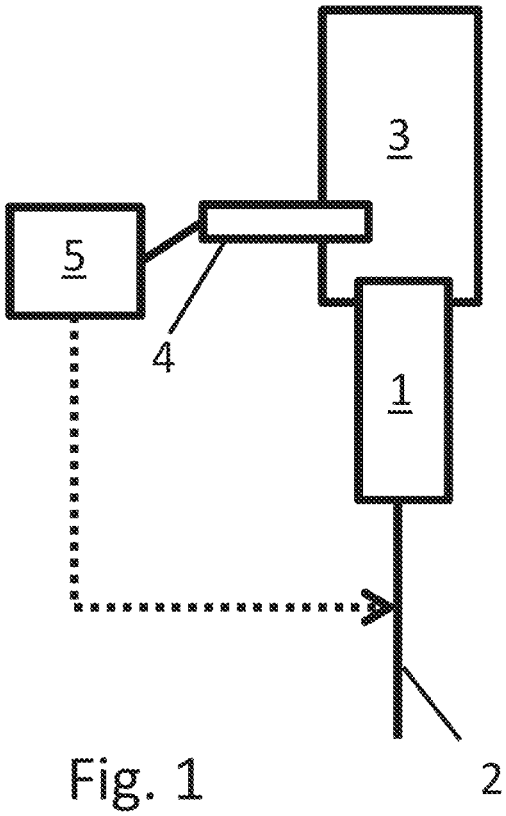
FIG. 1 shows a schematic bloc diagram of a burner arrangement according to the invention, FIGS. 2*a*) and *b*) show spectra without and with thermoacoustic effects, FIGS. 3*a*) and *b*) show curve courses of the ionization voltage and the area number at different outputs of the burner.
Figure 2:
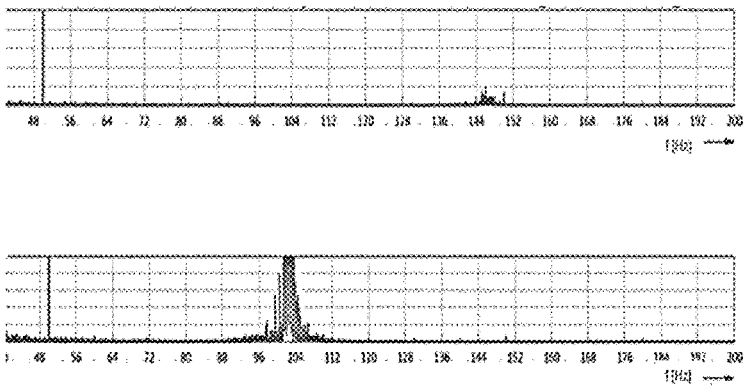
Figure 3:
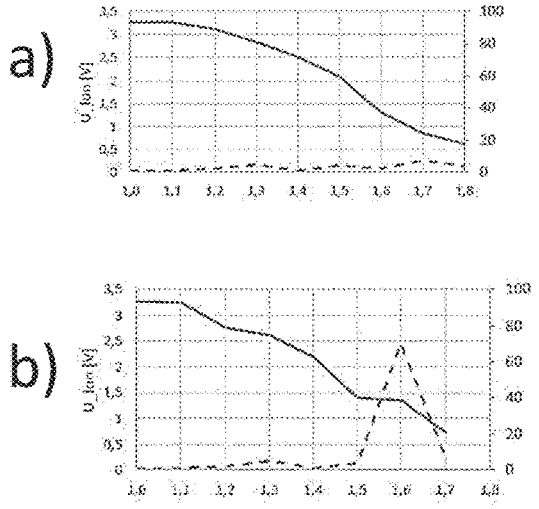

FIG. 1 schematically shows a burner arrangement comprising a burner 1 which is supplied with an air-fuel mixture via an air-fuel mixture supply 2. The fuel may be, for example, a combustible gas such as propane or butane. The flue gas generated by the combustion of the air-fuel mixture is supplied to a heat exchanger 3 which transfers the thermal energy to water or air. An ionization electrode 4 is provided for monitoring the combustion process, which is arranged relative to the burner 1 so as to project into the flame generated upon combustion. Depending on the design, an ionization voltage or an ionization current can be measured as an ionization signal via the ionization electrode 4. The ionization signal is fed to the control device 5 for evaluation. Based on the regulating variable thus obtained, the control device 5 acts on the air-fuel-mixture supply 2 by changing the fuel and/or air proportion, for example. This with the aim that the combustion takes place with as few emissions and as little noise as possible.

FIG. 2 to FIG. 5 exemplarily illustrate the evaluation of the ionization signal, wherein in particular thermoacoustic effects occur as disturbances. These noises are then avoided or at least reduced by changing the mixture ratio.

FIG. 2*a*) shows a spectrum of the ionization signal obtained by a FFT without audible thermoacoustic resonance. The frequency is plotted in Hz on the x-axis. The signal was obtained at an air ratio of 1.2. A signal of the mains voltage is appears at 50 Hz.

In FIG. 2*b*), a signal around 104 Hz appears in the spectrum, which is accompanied by an audible thermoacoustic resonance. The spectrum was obtained at an air ratio of 1.6.

According to one embodiment, a surface area is determined in a frequency range of the spectrum and used for a regulating variable during evaluation to reduce the resonance in the spectrum of FIG. 2*b*).

FIGS. 3*a*) and *b*) show the courses of the average values of the voltage values of the ionization signals (solid line and left y-axis) and the determined area numbers (dashed line and right y-axis) as a function of the air ratio. The graphs differ from each other in terms of the output obtained with the burner: in FIG. 3*a*), the power is 1 kW, and in FIG. 3*b*) 3,5 KW.

FIG. 3*a*) shows the case in which no thermoacoustic resonance is generated when the air ratio is changed. The higher the air ratio, the more the amount of the ionization voltage decreases. As no noises are generated, there is no additional signal in the spectrum so that the integral of the frequency range, i.e. the area number, remains constant.

In case of a higher power of the burner, the course changes significantly. In FIG. 3*b*), the amount of the ionization voltage decreases again, whereas a considerable increase in the area number can be seen at the air ratio of 1.6 (cf. FIG. 2*b*)). It has to be noted that in this range, the ionization voltage shows a very flat course. If the area number changes significantly, the setpoint value is corrected, with which the amount of the ionization voltage is used as a regulating variable for regulating the combustion process.

Figure 4:
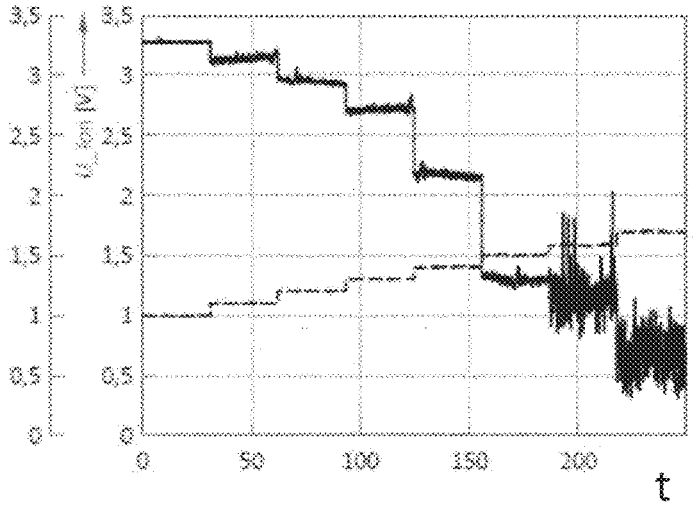
FIG. 4 shows curve courses of the air ratio and the ionization voltage over time.

FIG. 4 shows the variations which result from the measured values of the ionization voltage if disturbances occur. The lambda value is plotted on the outer y-axis, and the amount of the ionization voltage is plotted on the inner y-axis. The time is plotted on the x-axis. The lambda values were increased in discrete steps, as can be seen in the staircase shape of the dashed line.

The curve generally shows that the ionization voltage decreases as the lambda value increases. It can also be seen that there is a direct correlation with the voltage for each air ratio set. However, it can also be seen that the voltage values can vary greatly if there are disturbances. In the test here, these are clearly audible thermoacoustic resonances which occur at lambda=1.6 and lambda=1.7 (from approx. 180 seconds). The variations even have a clearly recognizable effect on the average value. The distribution alone is therefore also an indicator for the presence of a disturbance.

Figure 5:
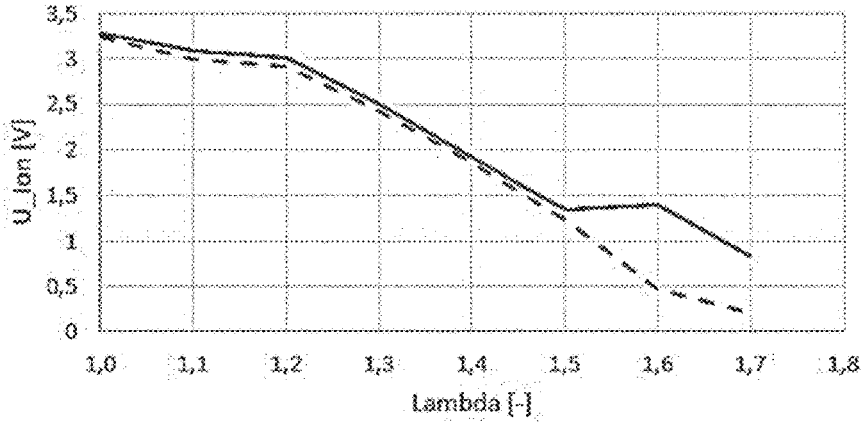
FIG. 5 shows two curves with a value of the ionization voltage and a regulating variable determined therefrom as a function of the air ratio.

Two curves are plotted in FIG. 5, one value being respectively plotted for the ionization voltage as a function of the lambda value.

In the solid curve, one unprocessed average value of the ionization voltage is respectively plotted. In the dashed curve, the difference between the average value and the associated distribution was calculated.

The decrease of the voltage is again recognizable from the solid curve. Due to the distribution in the range of the thermoacoustic effects, the average value in the range between lambda=1.5 and 1.6 is increased and remains nearly constant. The effect of this behavior on the regulation is indicated here. If, for example, the value of 1.4 V were specified as a setpoint value for the ionization voltage, two lambda values would thus be associated therewith. This means that the pure observation of the ionization voltage is not sufficient for regulation.

In the dashed curve, the distribution was respectively subtracted from the average value of the ionization voltage. The curve shifts downwards accordingly. A dramatic effect occurs in the range greater than 1.5 for lambda. The calculated value at lambda=1.6 differs significantly from the previous value at lambda=1.5. The increased distribution compensates for the increase in the average value. This results in a steadily decreasing course which allows clear regulation. Therefore, when the calculated voltage value decreases as a regulating variable in the range of the thermoacoustic resonance, the controller would determine that the regulating variable is smaller than a setpoint value and would then regulate the operating point in the rich range with a smaller lambda value.

The invention claimed is:

1. A burner arrangement, comprising:

a burner;

a heat exchanger;

an ionization electrode configured to measure an ionization signal;

an air-fuel-mixture supply configured to supply an air-fuel mixture to the burner; and a control device configured to:

determine a regulating variable based on the ionization signal;

act on the air-fuel-mixture supply to set the air-fuel mixture for the burner depending on the regulating variable and at least one setpoint value;

obtain, by a Fourier transformation, a spectrum from the ionization signal;

determine a value of an area under the spectrum or under at least one frequency range of the spectrum; and adjust the at least one setpoint value depending on the value of the area.

2. The burner arrangement of claim 1, wherein the control device is configured to determine at least one absolute value of an ionization voltage from the ionization signal and use the at least one absolute value of the ionization voltage as the regulating variable.

3. The burner arrangement of claim 2, wherein the control device is configured to determine a plurality of individual absolute values of the ionization voltage from the ionization signal, and wherein the control device is further configured to determine a distribution of the individual absolute values and adjust the regulating variable depending on the distribution.

4. The burner arrangement of claim 3, wherein the control device is configured to determine an average value and the distribution from the individual absolute values, and determine the regulating variable as a difference between the average value and the distribution.

5. The burner arrangement of claim 1, wherein the control device comprises a PID controller.

6. A method of regulating a burner, the method comprising:

supplying the burner with an air-fuel mixture;

measuring an ionization signal;

determining a regulating variable based on the ionization signal;

setting the air-fuel mixture depending on the regulating variable and at least one setpoint value;

obtaining, by a Fourier transformation, a spectrum from the ionization signal;

determining a value of an area under the spectrum or under at least one frequency range of the spectrum; and adjusting the at least one setpoint value depending on the value of the area.

7. The method of claim 6, wherein determining the regulating variable based on the ionization signal comprises:

determining at least one absolute value of an ionization voltage from the ionization signal; and using the at least one absolute value of the ionization voltage as the regulating variable.

8. The method of claim 7, wherein a plurality of individual absolute values of the ionization voltage is determined from the ionization signal, the method further comprising:

determining a distribution of the individual absolute values; and adjusting the regulating variable depending on the distribution.

9. The method of claim 8, wherein an average value and the distribution are determined from the individual absolute values, and wherein the regulating variable is determined as a difference between the average value and the distribution.

10. The method of claim 6, wherein the air-fuel mixture is set depending on the regulating variable by a PID controller.

* * * * *